US007171144B2

(12) United States Patent
Proper et al.

(10) Patent No.: US 7,171,144 B2
(45) Date of Patent: Jan. 30, 2007

(54) IMAGE DEFECT REDUCTION IN IMAGE DEVELOPMENT APPARATUS

(75) Inventors: James M. Proper, Webster, NY (US); Joo T. Chung, Webster, NY (US); Juan Morales-Tirado, West Henrietta, NY (US); Scott M. Silence, Fairport, NY (US); Zhaoyi Masucci, Penfield, NY (US); Kristen L. Ladue, Ontario, NY (US); Christine A. Keenan, Fairport, NY (US); Kimberly A. Stoll, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 87 days.

(21) Appl. No.: 11/049,695

(22) Filed: Feb. 4, 2005

(65) Prior Publication Data

US 2006/0177242 A1 Aug. 10, 2006

(51) Int. Cl.
*G03G 15/08* (2006.01)

(52) U.S. Cl. ..... 399/266

(58) Field of Classification Search ..... None
See application file for complete search history.

(56) References Cited

U.S. PATENT DOCUMENTS

| | | | |
|---|---|---|---|
| 4,292,387 | A | 9/1981 | Kanbe et al. |
| 4,459,009 | A | 7/1984 | Hays et al. |
| 4,557,992 | A | 12/1985 | Haneda et al. |
| 4,868,600 | A | 9/1989 | Hays et al. |
| 5,409,791 | A | 4/1995 | Kaukeinen et al. |
| 6,248,496 | B1 * | 6/2001 | Galloway et al. ..... 430/111.35 |

* cited by examiner

*Primary Examiner*—Quana Grainger
(74) *Attorney, Agent, or Firm*—Oliff & Berridge, PLC

(57) ABSTRACT

Super wire history image defects in an image development system including one or more electrode wires disposed in a gap between a toner donor roll and an imaging member are reduced by providing an initial toner composition in the image development system, the initial toner composition containing at least 30 number % fine particles having a particle size no greater than 5 μm; and providing replenisher toner into the development system to replenish the toner used to produce images by the image development system; the replenisher toner containing 20 number % or less fine particles having a particle size no greater than 5 μm.

21 Claims, 5 Drawing Sheets

IMAGE DEFECT REDUCTION IN IMAGE DEVELOPMENT APPARATUS

BACKGROUND

This invention relates generally to methods and products for reducing print image defects in scavengeless development systems. More particularly, the invention relates generally to methods and products for reducing visible image defects resulting from powder accumulation on electrode wires in such scavengeless development systems. The invention utilizes toner and developer compositions having increased toner fines, i.e., increased amounts and proportions of fine toner particles, to overcome this image defect.

In electrophotography, a photoreceptor containing a photoconductive insulating layer on a conductive layer is imaged by first uniformly electrostatically charging its surface. The photoreceptor is then exposed to a pattern of activating electromagnetic radiation, such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided toner particles on the surface of the photoconductive insulating layer. The resulting visible image may then be transferred from the photoconductor to a support, such as transparency or paper. This imaging process may be repeated many times.

Various toner compositions for such a printing system are well known in the art, and have been produced having a wide range of additives and constituent materials. Generally, however, the toner particles include a binding material such as a resin, a colorant such as a dye and/or a pigment, and any of various additives to provide particular properties to the toner particles.

Development may be interactive or non-interactive depending on whether toner already on the image may or may not be disturbed or removed by subsequent development procedures. Sometimes the terms scavenging and non-scavenging or scavengeless are used interchangeably with the terms interactive and non-interactive. Non-interactive or scavengeless development is most useful in color systems when a given color toner must be deposited on an electrostatic image without disturbing previously applied toner deposits of a different color, or cross-contaminating the color toner supplies.

Apparently useful non-interactive development methods known in the art work by generating a powder cloud in the gap between the photoreceptor and another member that serves as a development electrode. It is generally observed that this gap should be as small as possible, as small as 0.010 inches or smaller. Generally, the larger the gap, the larger become certain image defects in the development of fine lines and edges. The lines do not develop to the correct width, lines near solid areas are distorted, and the edges of solids are softened, especially at corners. It is believed that these defects are due to arches in the image electric fields over lines and at the edges of solid areas. In these arches electric field lines from image charges loop up and return to the photoreceptor ground plane instead of reaching across through the cloud to the development electrode. Defects result because toner in the cloud moves generally along field lines and cannot cross them into the arches, with the result that the deposited toner distribution does not correspond to image charge distribution. Defects due to field arches are less serious in interactive two component development because toner is carried into the arches by carrier particles.

Nor are they very serious in interactive single component development exemplified by U.S. Pat. No. 4,292,387 to Kanbe et al. because a strong, cross-gap AC field is superposed which overcomes the aforementioned field arch patterns.

In non-scavenging systems cross gap AC fields are also applied. However, it is important to realize that if such fields are made too strong, the system will become interactive due to toner impact on already developed images. Thus a system may image well at strong fields and develop non interactively at weak fields, but not do both simultaneously. The development electrode and its role in determining electric field structure is described, for example by H. E. J. Neugebauer in *Xerography and Related Processes*, Dessauer and Clark, Focal Press, 1965. Powder cloud development is described, for example, in the paper "High Sensitivity Electrophotographic Development" by R. B. Lewis and H. M. Stark in *Current Problems in Electrophotography*, Berg and Hauffe, Walter de Gruyter, Berlin, 1972.

U.S. Pat. No. 4,868,600 to Hays et al discloses a non-interactive development system wherein toner is first developed from a two-component developer onto a metal-cored donor roll and thereafter disturbed into a powder cloud in the narrow gap between the donor roll and an electrostatic image. Development fields created between the donor roll core and the electrostatic image harvest some of the toner from the cloud onto the electrostatic image, thus developing it without physically disturbing it. In this method the powder cloud generation is accomplished by thin, AC biased wires strung across the process direction and within the development gap. The wires ride on the toner layer and are biased relative to the donor roll core. The method is subject to wire breakage and to the creation of image defects due to wire motion, and these problems increase as the process width is increased. In this system it has been found important for image defect reduction to minimize the gap between the donor and the surface of the electrostatic image in order to create a close development electrode. Gap spacings of about 0.010 inches are characteristic. They would be smaller were it practical to maintain the necessary tolerances.

U.S. Pat. No. 4,557,992 to Haneda et al. describes a non-interactive magnetic brush development method wherein a two component developer employing magnetically soft carrier materials is carried into close proximity to an electrostatic image and caused to generate a powder cloud by the developer motion, sometimes aided by an AC voltage applied across the gap between the brush and the ground plane of the electrostatic image. Cloud generation directly from the surfaces of a two component developer avoids the problems created by wires. However, in practice such methods have been speed limited by their low toner cloud generation rate.

U.S. Pat. No. 5,409,791 to Kaukeinen et al. describes a non-interactive magnetic brush development method employing permanently magnetized carrier beads operating with a rotating multipole magnet within a conductive and nonmagnetic sleeve. Magnetic field lines form arches in the space above the sleeve surface and form chains of carrier beads. The developer chains are held in contact with the sleeve and out of direct contact with the photoreceptor by gradients provided by the multipole magnet. As the core rotates in one direction relative to the sleeve, the magnetic field lines beyond the sleeve surface rotate in the opposite sense, moving chains in a tumbling action which transports developer material along the sleeve surface. The strong mechanical agitation very effectively dislodges toner particles generating a rich powder cloud which can be developed to the adjacent photoreceptor surface under the influence of development fields between the sleeve and the electrostatic image.

Nevertheless, there continues to be a need for improved development processes. In particular, there continues to be a need for improved development processes such that print image defects can be reduced or eliminated, thereby to provide more desirable printed images.

SUMMARY

Despite the many different scavengeless development designs, print image defects of varying severity remain, which are desired to be eliminated.

One such print image defect is a visible image defect that results from a transient change in the state of the wires (or electrodes) that are located in the gap between a toner donor roll and the imaging member, i.e., the wires or electrodes that generate the toner cloud for non-interactive development. This change of state can be attributed to, for example, the amount and kind of toner that is accumulated on the wires. The visible image defect also is believed to result from the changing image content, i.e., background, halftones, or solid areas. This image defect is referred to herein as "Super Wire History" or SWH, but it refers to the image defect caused by transient changes in the wire state and image. The image defect appears as a steak or ghost in a single color separation that lines up with the preceding image content, or inter-document zone patches.

The ideal condition would be to have no toner accumulation on the wires at any image content condition, as this by definition would result in no change-of state of the wire, and therefore would eliminate the SWH image defect. Unfortunately, current toner and developer designs do not achieve this ideal condition, and instead continue to result in toner accumulation. However, the inventors have discovered that an equilibrium condition is achieved in the developer housing, that is, that an equilibrium accumulation amount is reached after sufficient images have been printed. As shown in FIG. 1, the SWH defect is minimized when this equilibrium condition is reached after about 50,000 prints.

One approach that has been taken in the art has been to run and discard prints from an image development system until the equilibrium accumulation amount is reached and thus the SWH image defect is eliminated. However, this requires running and discarding up to 50,000 prints, which is impractical in many cases and results in large waste of materials.

As an alternative solution, the present inventors have discovered that the SWH image defect can be avoided by quickly achieving an equilibrium accumulation amount of toner on the wires. That is, the equilibrium accumulation amount of toner on the wires can be achieved much sooner than the approximately 50,000 prints that are currently required. This in turn provides for more economical product development and use, while providing more consistent, improved image quality.

Accordingly, in embodiments, a method is provided for reducing print image defects in printing apparatuses, such as scavengeless development systems, attributable to Super Wire History. In embodiments, such print image defects are reduced by quickly achieving an equilibrium accumulation amount of toner on the wires. This is achieved by initially charging the developer system with a toner/developer composition that has an increased fines content, i.e., an increased amount of toner particles in the low particle size end of a particle size distribution, than is, conventionally used for such development systems. The system thereby initially has, or very quickly reaches, an equilibrium fines particle content that otherwise would not be reached until after many prints are produced.

In particular, embodiments provide a method for reducing super wire history image defects in an image development system comprising one or more electrode wires disposed in a gap between a toner donor roll and an imaging member, said method comprising:

providing an initial toner composition in said image development system, said initial toner composition containing at least 30 number % fine particles haying a particle size no greater than 5 μm; and providing replenisher toner into the development system to replenish the toner used to produce images by the image development system; wherein said replenisher toner contains 20 number % or less fine particles having a particle size no greater than 5 μm.

In other embodiments, there is provided an apparatus for developing latent electrostatic images on a charge retentive surface with toner, said apparatus comprising:

a charge retentive surface;

a development unit comprising an initial supply of toner comprising at least 30 number % fine particles having a particle size no greater than 5 μm;

a replenisher toner supply unit for supplying replenisher toner to said development unit as toner in said development unit is used, wherein said replenisher toner comprises 20 number % or less fine particles having a particle size no greater than 5 μm;

a donor structure spaced from said charge retentive surface for conveying toner from said development unit to an area opposite said charge retentive surface; and one or more electrode wires positioned in a gap between said charge retentive surface and said donor structure and sufficiently close to said donor structure to permit detaching of toner from a surface of said donor structure by an electrostatic field to thereby produce toner clouding about said one or more electrode wires.

BRIEF DESCRIPTION OF THE DRAWINGS

Various details are described with reference to the drawings, wherein like numerals represent like parts, and wherein.

DETAILED DESCRIPTION OF PREFERRED EMBODIMENTS

Figure 1:
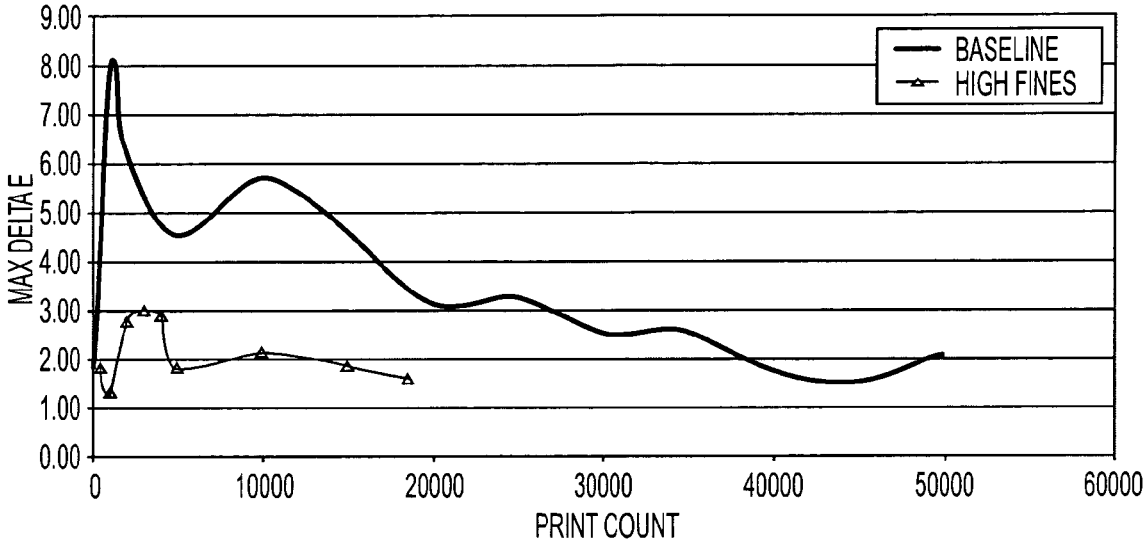
FIG. 1 shows a graph of SWH image defect versus print count for a conventional toner/developer housing and a toner/developer housing according to the invention.

To reduce print image defects in printing apparatuses, such as scavengeless development systems, attributable to Super Wire History, improved toner/developer compositions are provided. According to the prior art a new toner/developer composition would typically contain an amount of size classified toner particles mixed with developer carrier particles. The inventors have discovered that a modified toner composition can be provided having increased fine particle content, to overcome the SWH image defect problem.

Typical toner compositions can be mono-modal (having a single peak in the particle size distribution), bimodal (having two distinct peaks in the particle size distribution), or multi-modal, as desired. However, in nearly all toner compositions, the individual particles are not all the same size, thereby providing a particle size distribution. In such distributions, the toner composition is typically identified by its average particle size, it being understood that "tails" exist in the particle size distribution including smaller and larger sized particles. The inventors have unexpectedly discovered that increasing the tail of fine particles, i.e., particles having a size less than the average particle size of the toner composition, can reduce the SWH image defect.

For example, a typical toner composition for use in various development processes, including scavengeless or non-interactive development, has a particle size range of from about 4 μm to about 12 μm, preferably from about 6 to about 10 μm, with an average particle size of about 8 to 8.5 μm. This toner composition includes an amount of "fine" particles, which are the smaller sized particles in the small particle size tail of the particle size distribution. Such amount of fine particles is typically maintained at an amount of less than about 15% by number, such as about 10–13% by number, as measured by a Coulter Counter.

As used herein, "fine particles" in referring to a portion of the toner particle size distribution refers to toner particles having a particle size of less than 5 μm. "Fine particles" as used herein is not particularly dependent upon the average particle size of a toner composition, as these fine particles are the particles that are believed to most directly become accumulated on the wires and thus affect the SWH image defect problem. Thus, for example, if a toner composition has an average particle size of 12 μm or greater, fine particles would still be considered to be those particles having a particle size of less than 5 μm.

In more rigorous embodiments, lower cutoff levels can be used to alternatively define the small-sized particles that are included in the toner compositions. Thus, for example, while "fine particles" above is defined as particles having a particle size of less than 5 μm, embodiments can be provided where the small sized particles that are present are defined as particles having a particle size of less than 4 μm, or particles having a particle size of less than 3 μm. Where such smaller sized particles are used, the below-described loading amounts would still apply. That is, for example, one embodiment of the modified toner composition would have from, about 40 to about 60 number % of particles having a particle size of less than 4 μm.

According to embodiments, the toner composition is modified to include a larger amount of finer particles than is typical for a toner composition. Thus, for example, the toner composition is modified to include at least about 25% fine particles, more preferably at least about 30% fine particles, and even more preferably at least about 40% fine particles. In embodiments, the toner composition is modified to include from about 30 to about 70% fine particles, or from about 40 to about 60% fine particles. Preferred in embodiments is a toner composition that is modified to include about 50% fine particles. Here, percentages refer to a number percent, i.e., number of fine particles based on a total number of particles, as measured for example by a Coulter counter or other appropriate particle counter.

Figure 5:
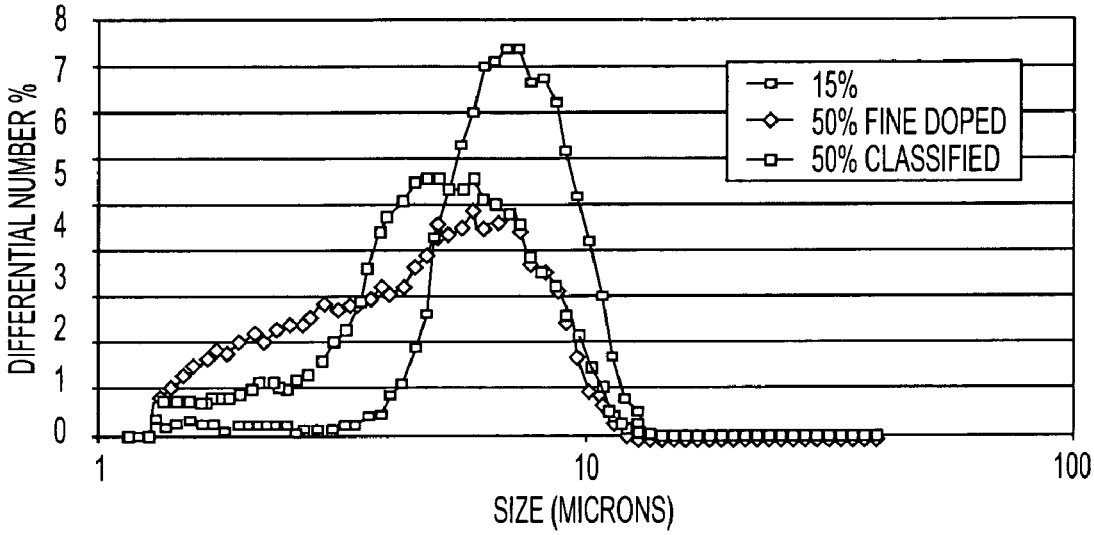
FIG. 5 is a graph of particle size distributions for three toner compositions.
Figure 6:
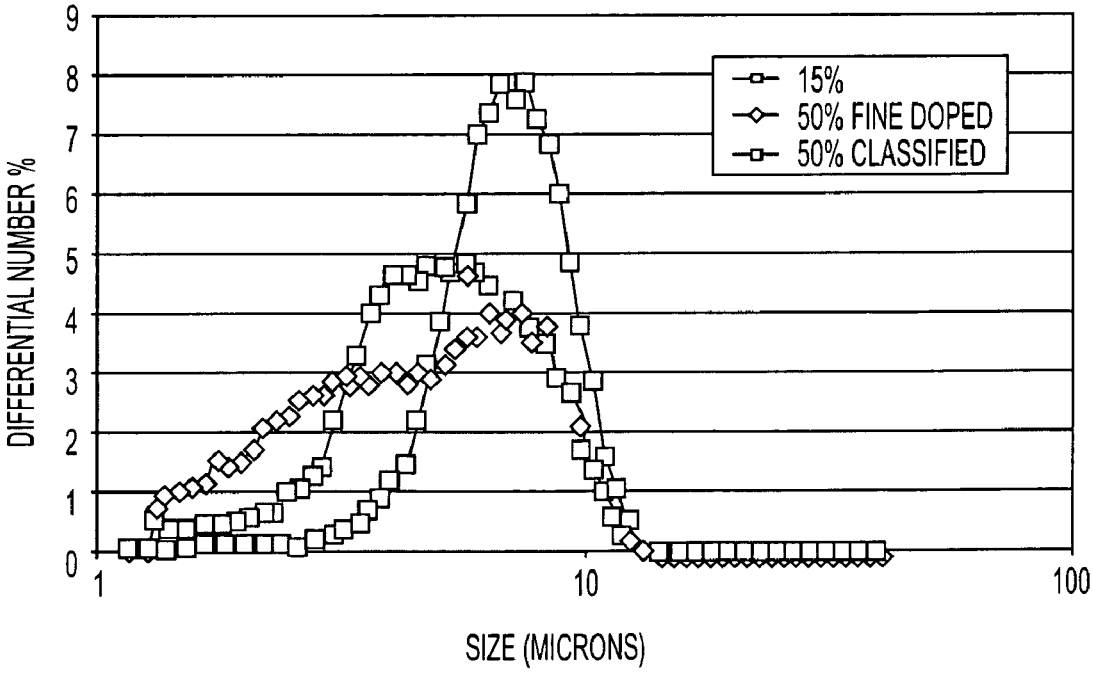
FIG. 6 is a graph of particle size distributions for three toner compositions.

FIGS. 5 and 6 graphically show comparisons of particle size distributions for toner compositions described above. In particular, FIGS. 5 and 6 show the particle size distributions for typical toner compositions having a fines content of less than 15%, and particle size distributions for modified toner compositions having a fines content of about 50%, which are made by two separate processes. The figures show that the modified toner compositions have a much broader lower size tail, indicative of the higher fines content.

The inventors have discovered that use of the modified toner compositions when initially charging a developer apparatus, results in a significant decrease in the SWH image defect. It is believed that this result is obtained because for a typical toner composition, over time, the fines particles accumulate in the developer apparatus, and accumulate on the wires. This accumulation of fines particles eventually reaches an equilibrium value of about 50 number %, but only after about 50,000 prints have been made. This effect is shown in the graph of FIG. 1, discussed above. In contrast, because the modified toner compositions already have a higher number % of fine particles, the toner accumulation on the wires reaches equilibrium significantly faster, after about only 5,000 prints. Furthermore, with the modified toner compositions, the magnitude of change of state of the wire is much lower even before equilibrium is reached, resulting in less visible image defects even at start-up of the developer apparatus. See FIG. 1.

In FIG. 1, the vertical axis represents $\Delta E_{max}$, and the horizontal axis represents the number of copies (prints) that have been made since initially loading the given material in the developer housing. ΔE represents the spectral color difference between two locations on a print sample using the Munsell System of Color Measurement. A spectrophotometer is used to measure the location of a single point on the print within the three dimensional color space: lightness (L*), saturation and hue (a* and b*). ΔE is calculated as the difference between two locations in this three dimensional space. For SWH, ΔE is measured between two points in a halftone region of equal density 0.5 inches following a solid area and a background area in the process direction of the print. This is done in two places on the print and the maximum ΔE value of the two is used to quantify SWH for a given print. Measurement error is about 1 ΔE. Values greater than about 2 are generally perceptible to the human eye, and thus represent visible image defects. Values between 2 and 4 are objectionable to some users. Values above 4 are generally objectionable to most users.

In embodiments, the fresh (or initial) modified toner composition is provided such that ΔE between a region that has the SWH defect and a background area where there is no image content change does not exceed about 6 during a useful life of said fresh (or initial) toner composition. Preferably, the ΔE does not exceed about 5, more preferably about 4, and even more preferably about 3, during a useful life of said fresh (or initial) toner composition.

Various methods can be used and will be apparent to those skilled in the art for preparing the modified toner compositions having an increased amount of fine particles. For example, as illustrative methods, three suitable methods will be described below, it being understood that these methods are not limiting and exclusive.

A first suitable method is to add classified, small-sized toner particles to a conventional toner composition. This method utilizes classified toner particles, such as classified toner particles having an average particle size in the 2–4 micron range. These classified toner particles can be added to the conventional toner composition during the blending stage, similar to the manner in which other toner additives are added. Appropriate blending amounts can be selected, such as based on the toner particle size and particle size distribution, and the classified toner particle size and particle size distribution, to provide the desired final particle size distribution with the fine particle content. One possible drawback to this method, however, is that it may require process changes depending on the specific particle size distributions of each toner composition and classified toner composition batch, to account for size variations. However, this issue can be readily addressed by those skilled in the art. This process would also increase the content of ultra-fine particles (particles having a size less than 2 microns) in the final modified toner composition.

A second suitable method is to divert ground stock directly to the blending process. That is, this method is similar to the above-described first process, except that fine particles,resulting from the toner grinding process are fed to the toner blending step, without first being classified into specific particle size ranges. Again, appropriate blending amounts can be selected, such as based on the toner particle size and particle size distribution, and the ground toner particle size and particle size distribution, to provide the desired final particle size distribution with the fine particle content. Possible drawbacks to this method include the possible need to re-grind the grinder effluent in order to provide sufficiently sized and amounts of fine particles, and the possible need to increase the target average particle size of the overall modified toner composition. However, each of these issues can be readily addressed by those skilled in the art. This process would also increase the content of ultra-fine particles (particles having a size less than 2 microns) in the final modified toner composition.

A third suitable method is to apply the usual toner processing steps to the product, but adjust the classification process to leave a significantly higher percentage of small sized fines in the toner than in the conventional case above. In this method, ground stock is processed through at least one classification step between grinding and blending. Thus, small sized particles generated in the grinding process can be classified into desired particle size range, for subsequent blending into the conventional toner composition. Using this process, for example, the classification process can be adjusted to remove the ultra-fine particles (particles having a size less than 2 microns) but leave many of the toner fines in the size range of between 2 and 5 microns in the final toner composition. This process would provide more consistent product, although equipment and process modifications may be necessary to incorporate the classification step and to ensure target particle sizes are obtained. For example, a vibrator may be required at the feed hopper to prevent flow problems resulting from the high fines content. However, each of these issues can be readily addressed by those skilled in the art. This process would also, provide a benefit that the content of ultra-fine particles can be minimized. Thus, in embodiments, the modified toner composition can include none, or at least substantially none, of ultra-fine particles, i.e., particles having a particle size no greater than about 2 μm.

Once these modified toner compositions are prepared, and are optionally prepared into modified developer compositions by mixing with carrier particles as is known in the art, the compositions can be used as the initial toner or developer charge for a development system. "Initial toner charge" for a development system is used herein to refer to initial use of the composition after its production, as opposed to a toner composition that transiently exists during use or after many prints have been made. Likewise, "fresh toner" or "initial toner" is used herein to refer to a new, unused toner composition, as opposed to a toner composition that transiently exists during use or after many prints have been made. Thus, for example, the modified toner compositions, before any development use, are provided to have a composition that parallels the toner composition that otherwise transiently exists from an equilibrium state following printing of around 50,000 prints. However, while the initial toner charge modified toner compositions may otherwise appear equivalent to the used, conventional toner composition, as described above the modified toner compositions do not exhibit the high SWH image defect problem associated with conventional toners.

The image development system also includes a replenisher toner composition. The replenisher toner composition can, but need not, include a desired amount of carrier particles, to concurrently replenish carrier particles that may be otherwise withdrawn from the development system, as is known in the art. The replenisher toner composition is provided in the image development system to provide the bulk toner composition that is used to develop images. In embodiments, the replenisher toner composition contains about 20 number % or less fine particles having a particle size no greater than 5 μm, and preferably less than 15 number % fine particles having a particle size no greater than 5 μm. As above, these percentages refer to a number percent, i.e., number of fine particles based on a total number of particles, as measured for example by a Coulter counter or other appropriate particle counter. The number % of fines in the replenisher toner composition is thus less than the number % of fines in the initial toner or developer composition. Furthermore, despite the increased number % of fines in the initial toner or developer composition, the actual proportion of fines that appears in the developed image, i.e., the amount of fines that are transferred and fixed to form a printed image, generally corresponds to the content of the replenisher toner composition.

In embodiments, the initial toner composition can be used in an image forming apparatus that includes one or more electrode wires disposed in a gap between a toner donor roll and an imaging member. The initial toner composition can be used, for example, by charging the initial toner composition into the image development system, and optionally thereafter operating the image development system to provide one or more printed images. In embodiments, the one or more electrode wires do not have any accumulated toner particles thereon prior to operating the image development system to provide the one or more printed images. Alternatively, the electrode wires can have some accumulated toner particles thereon, such as less than an eventual equilibrium amount of accumulated toner, or less than half of an eventual equilibrium amount of accumulated toner. Thus, in these embodiments, a conventional toner composition would require a much longer time to achieve equilibrium accumulation of toner particles on the electrode wires, than is required when a larger amount of fine particles are included in the initial modified toner compositions.

Figure 2:
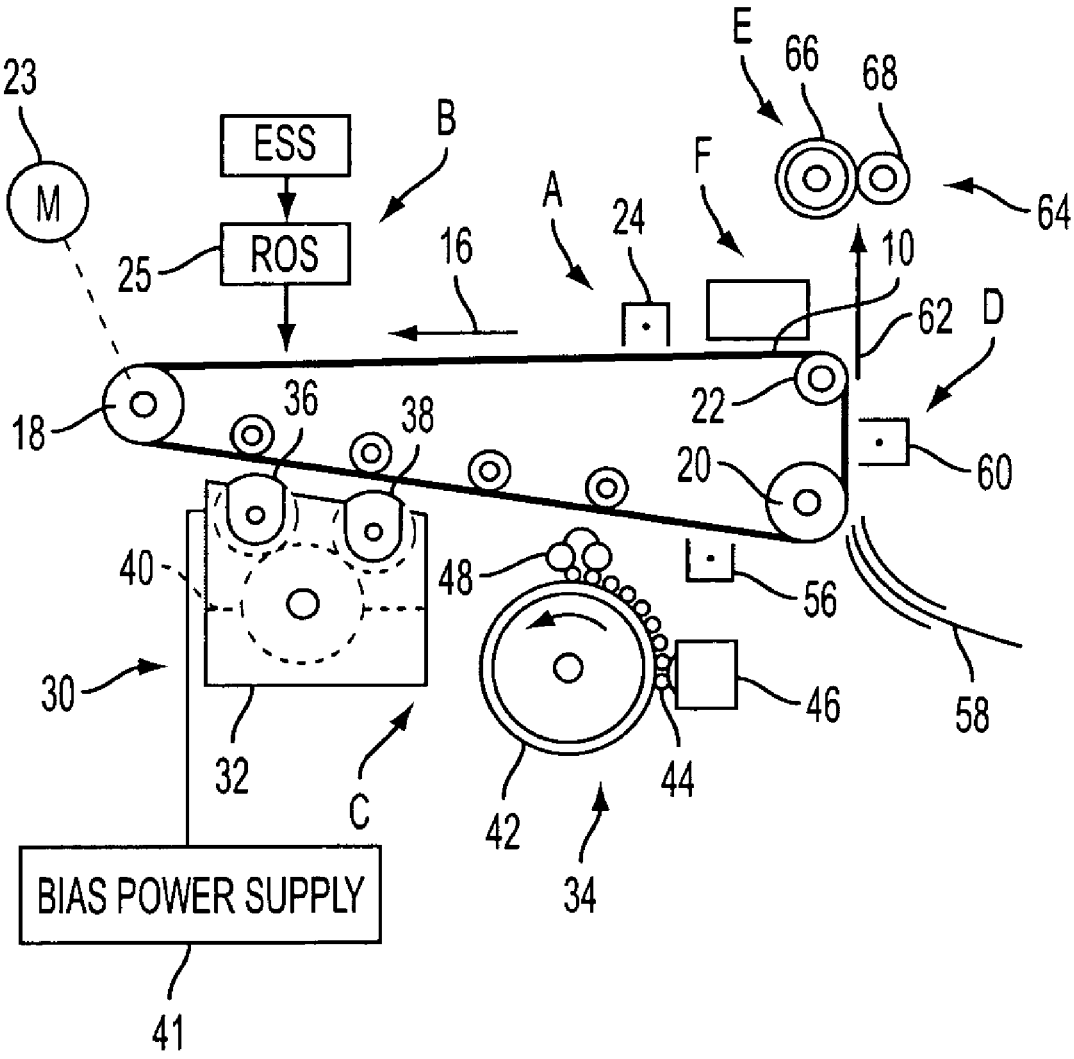
FIG. 2 is schematic illustration of a scavengeless development printing apparatus.

An exemplary scavengeless development system is shown in FIG. 2. As shown in FIG. 2, a printing machine may utilize a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Preferably charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device.

The photoreceptor, which is initially charged to a voltage $V_0$, undergoes dark decay to a level $V_{ddp}$ equal to about 900 volts. When exposed at the exposure station B it is discharged to $V_c$ equal to about 100 volts which is near zero or ground potential in the highlight (i.e. color other than black) color parts of the image. The photoreceptor is also discharged to $V_w$ equal to 500 volts imagewise in the background (white) image areas.

At development station C, a development system, indicated generally by the reference numeral 30 advances developer materials into contact with the electrostatic latent images. The development-system 30 comprises first and second developer apparatuses 32 and 34. The developer apparatus 32 comprises a housing containing a pair of magnetic brush rollers 36 and 38. The rollers advance developer material 40 into contact with the latent images on the charge retentive surface which are at the voltage level $V_c$. The developer material 40 by way of example contains red toner. Appropriate electrical biasing is accomplished via power supply 41 electrically connected to developer apparatus 32. A DC bias of approximately 400 volts is applied to the rollers 36 and 37 via the power supply 41.

The developer apparatus 34 comprises a donor structure in the form of a roller 42. The donor structure 42 conveys single component developer 44 deposited thereon via a combination metering and charging device 46 to adjacent an electrode structure. The developer in this case comprises black toner. The donor structure can be rotated in either the "with" or "against" direction vis-a-vis the direction of motion of the charge retentive surface. The donor roller 42 is preferably coated with TEFLON-S (trademark of E.I. DuPont De Nemours).

The combination metering and charging device may comprise any suitable device for depositing a monolayer of well charged toner onto the donor structure 42. For example, it may comprise an apparatus such as described in U.S. Pat. No. 4,459,009 wherein the contact between weakly charged toner particles and a triboelectrically active coating contained on a charging roller results in well charged toner. Other combination metering and charging devices may be employed, for example, a conventional magnetic brush used with two component developer could also be used for depositing the toner layer onto the donor structure.

Figure 4:
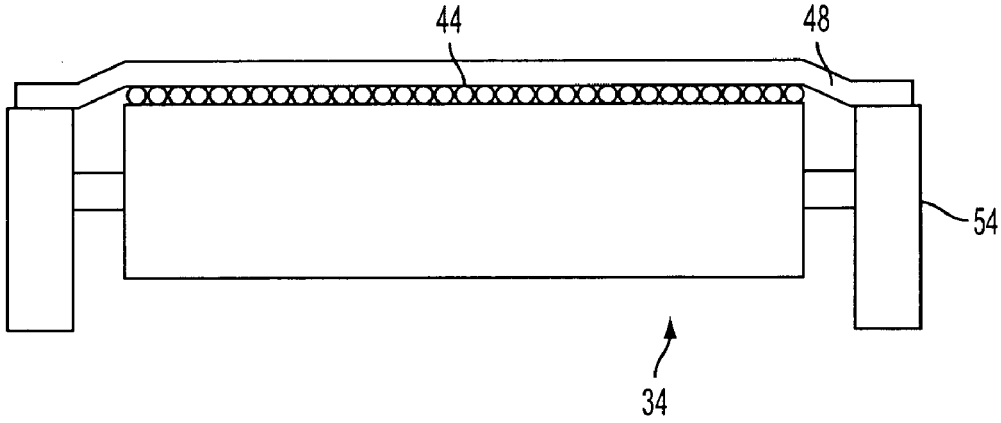
FIG. 4 is a fragmentary view from a different direction of the developer apparatus of FIG. 3.

The developer apparatus 34 further comprises an electrode structure 48 which is disposed in the space between the charge retentive surface 10 and the donor structure 42. The electrode structure is comprised of one or more thin (i.e. 50 to 100 micron diameter) stainless steel wires which are lightly positioned against the donor structure 42. The distance between the wires and the donor is approximately 25 microns or the thickness of the toner layer on the donor roll. The wires, as can be seen in FIG. 4, are self-spaced from the donor structure by the thickness of the toner on the donor structure. To this end the extremities of the wires supported by the tops of end bearing blocks 54 which also support the donor structure for rotation. The wire extremities are attached so that they are slightly below a tangent to the surface, including toner layer, of the donor structure. Mounting the wires in such a manner makes them insensitive to roll runout due to their self-spacing.

Figure 3:
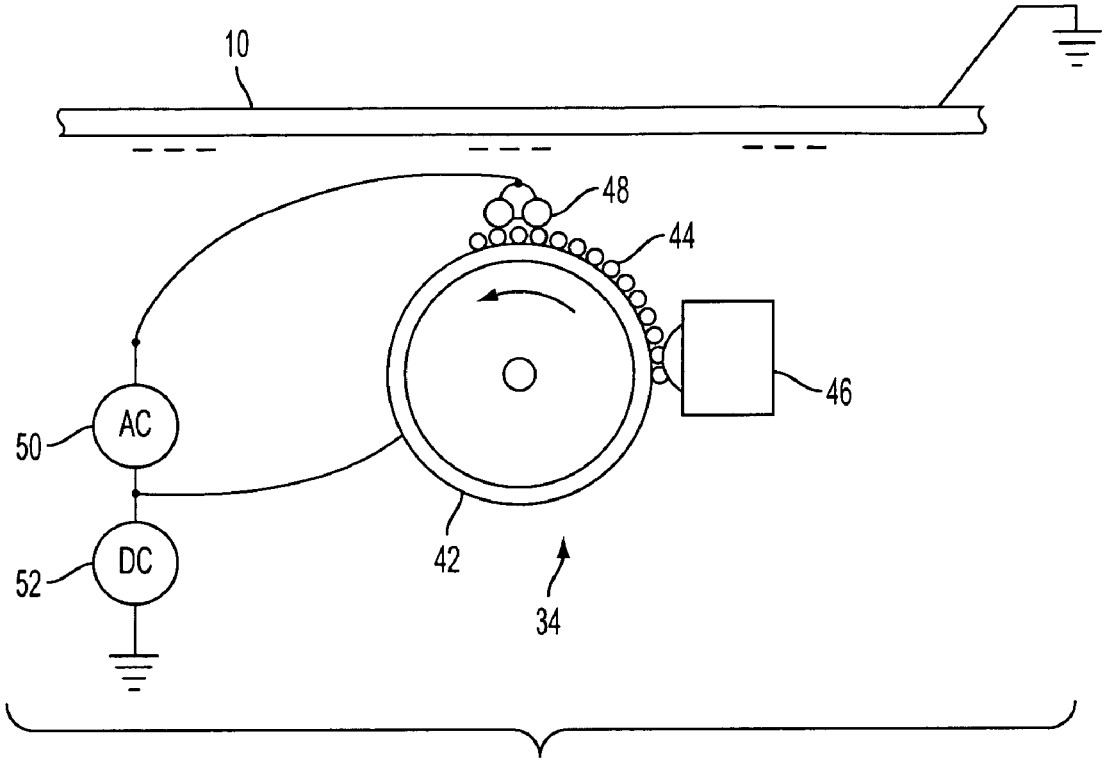
FIG. 3 is a fragmentary schematic illustration of a scavengeless development printing apparatus.

As illustrated in FIG. 3, an alternating electrical bias is applied to the electrode structure via an AC voltage source 50. The applied AC establishes an alternating electrostatic field between the wires and the donor structure which is effective in detaching toner from the surface of the donor structure and forming a toner cloud about the wires, the height of the cloud being such as not to contact with the charge retentive surface. The magnitude of the AC voltage is relatively low and is in the order of 200 to 300 volts peak at a frequency of about 4kHz up to 10 kHz. A DC bias supply 52 which applies approximately 700 volts to the donor structure 42 establishes an electrostatic field between the charge retentive surface of the photoreceptor 10 and the donor structure for attracting the detached toner particles from the cloud surrounding the wires to the latent image on the charge retentive surface. At a spacing of approximately 25 microns between the electrode and donor structures an applied voltage of 200 to 300 volts produces a relatively large electrostatic field without risk of air breakdown. The use of a dielectric coating on either of the structures helps to prevent shorting of the applied AC voltage. The field strength produced is in the order of 8 to 12 volts/micron. While the AC bias is illustrated as being applied to the electrode structure it could equally as well be applied to the donor structure.

A sheet of support material 58 (FIG. 2) is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto a backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

While the developer apparatus 32 has been disclosed as a magnetic brush system, developer apparatus 34 could be used in its place. Also, while the development of discharged area images was illustrated as being effected prior to charged area development the sequence of image development can be reversed in the case where apparatus 34 is used in place of apparatus 32.

While the invention has been described in conjunction with the specific embodiments described above, it is evident that many alternatives, modifications and variations are apparent to those skilled in the art. For example, it will be apparent that the embodiments described above are not limited to the particular development apparatus of FIGS. 2–4, and that other development apparatuses can be readily used. Accordingly, the preferred embodiments as set forth above are intended to be illustrative and not limiting. Various changes can be made without departing from the spirit and scope of the invention.

An example is set forth herein below and is illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLES

Comparative Example 1

A cyan toner is prepared by melt mixing together 12.7% by weight of a dispersion of PV Fast Blue in SPARII (3.8% by weight pigment loading total) in a propoxylated bisphenol A fumarate resin having a gel content of about 8% by weight. The toner also comprises as external surface additive package including 3.4% by weight HMDS treated silica with a 40 nanometer average particle diameter, 1.9% by weight decyltrimethoxysilane (DTMS) treated titania with a 40 nanometer average particle diameter (SMT-5103, available from Tayca Corporation), 0.1% by weight hydrophobic fumed silica with a coating of polydimethyl siloxane units and with amino/ammonium functions chemically bonded onto the surface (H2050, obtained from Wacker Chemie), and 0.5% by weight Zinc Stearate L available from Ferro Corporation.

The toner has a volume median particle size of about 8.3 μm, with percent fines less than 5 μm of no more than 15% by number as measured by a Coulter Counter.

This toner is formed into a developer by combining with a carrier comprised of a 80 μm steel core (supplied by Hoeganaes North America Corporation) coated with 1% by weight PMMA (supplied by Soken) at 200° C.

The developer thus produced is charged into a developer apparatus, and 50,000 prints are made using changing image content. During the production of the prints, the toner (replenisher toner) dispensed into the developer has the same composition, and in particular the same percentage of fines, as was present in the developer as initially charged into the developer apparatus. $\Delta E_{max}$ values are measured during the printing process, where ΔE represents a difference between a region that has the SWH defect and a background area where there is no image content change. ΔE values greater than about 2 are generally perceptible to the human eye, and thus represent undesirable visible image defects. The results are shown in FIG. 1. As shown in the figure, $\Delta E_{max}$ of the initial developer composition starts at about 1.8, but quickly rises to a value of about 8 as the developer composition is used, that is, as toner particles are consumed and small sized (fine) particles are accumulated on the electrode wires. As printing continues, $\Delta E_{max}$ slowly drops to an equilibrium value around 2 as printing proceeds though about 50,000 prints.

When the $\Delta E_{max}$ value is high, unscheduled service calls are typically made by the customer based on unacceptable print quality. Prints during this time may be unacceptable to them. The higher the $\Delta E_{max}$, the more customers object and are therefore more likely to place a service call. If a service call is placed, adjustments must be made to the developer housing bias settings to mitigate the appearance of the ΔE difference. Adjusting the bias setpoints will help reduce or eliminate SWH, but can lead to other image quality problems associated with HSD development—harmonic strobing of the HSD wires and development breakdown between the wires and donor rolls. Therefore, some customers may continually bounce between bias setpoints depending on what artifact is present, creating a service call each time.

Figure 7:
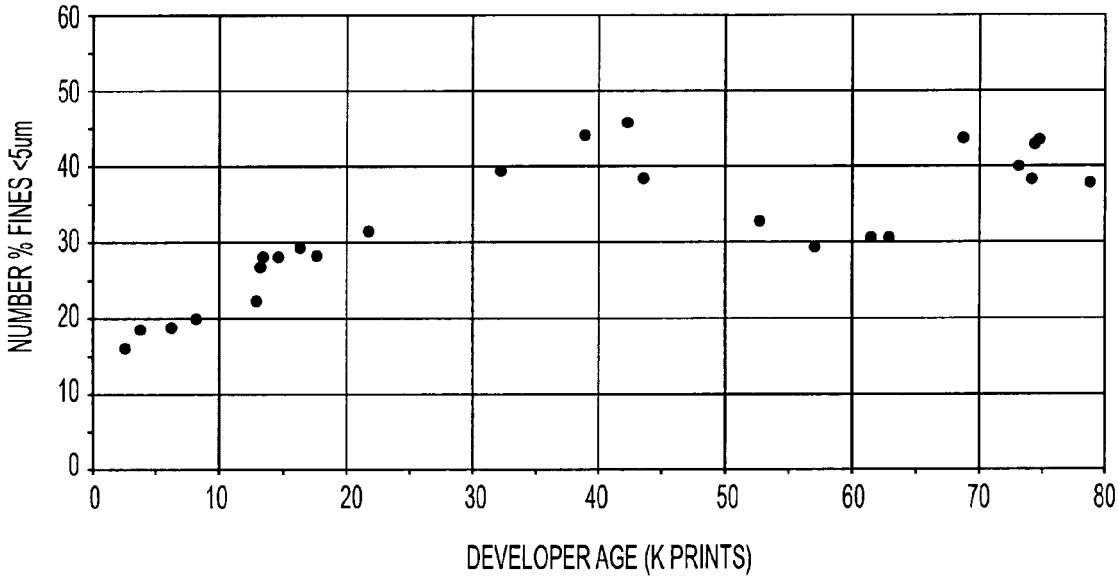
FIG. 7 is a graph showing how the percent content of fine particles increases in a developer housing based on the number of prints that have been made.

During the printing process described above, the number % content of fine particles in the developer housing is also measured. The results are shown in FIG. 7. As shown in the figure, the number percent content of fine particles slowly increases from an initial state of about 16 number % to around 40 number % as the number of prints proceeds. The graph shows that fine particle levels plateaus between 30 and 45 number %. The plateau of fines occurs around 30,000–50,000 prints developer age, which is similar to when the SWH image defect goes away.

Example 1

A cyan toner is prepared according to the procedures of Comparative Example 1. However, in the blending step of blending the components together, additional fine particles (size <5 microns) are added -to achieve a percent fines less than 5 μm of about 50% by number as measured by a Coulter Counter. In this Example, the fine particles are classified, small-sized toner particles.

The toner has a volume median particle size of about 8.3 μm, with percent fines less than 5 μm of about 50% by number as measured by a Coulter Counter.

This toner is formed into a developer by combining with a carrier comprised of a 80 μm steel core (supplied by Hoeganaes North America Corporation) coated with 1% by weight PMMA (supplied by Soken) at 200° C., as in Comparative Example 1.

Also as in Comparative Example 1, the developer thus produced is charged into a developer apparatus, and 20,000 prints are made using changing image content. During the production of the prints, the toner (replenisher toner) dispensed into the developer has the same composition of Comparative Example 1, and in particular the percentage of fines is about 15% less than 5 microns, which is different from the fines level present in the developer as initially charged into the developer apparatus. $\Delta E_{max}$ values are measured during the printing process, and the results are shown in FIG. 1. As shown in the figure, $\Delta E_{max}$ of the initial developer composition starts at about 1.8, similar to the Comparative Example 1. However, because the fine particle content is high and near the eventual equilibrium value, $\Delta E_{max}$ variation is much less, and reaches a maximum value of only about 3 as the developer composition is used. As printing continues, $\Delta E_{max}$ quickly drops to an equilibrium value less than around 2 as printing proceeds though only about 5,000 prints. The decrease in $\Delta E_{max}$ during this time with the higher fines materials provides more latitude for HSD development. Maximum values in the 3 range are much less objectionable to the customer and fewer service calls will be placed for SWH. Furthermore, developer housing bias setpoints can be re-optimized with the high fines materials to mitigate SWH, harmonic strobing and development breakdown. The re-optimized setpoints should provide acceptable image quality to the majority of customers.

The results of Example 1 and Comparative Example 1 show that increasing the fine particle content more quickly achieves an equilibrium in the developer apparatus, and reduced SWH. Example 1 shows significantly improved results, both in terms of equilibrium being obtained in a much shorter time—5,000 prints rather than 50,000 prints, but also in terms of significantly reduced SWH before equilibrium is achieved—a maximum value of about 3 for a shorter period of time, rather than a maximum value of about 8 and elevated levels for a longer period of time.

Example 2

A series of cyan toners are prepared according to the procedures of Comparative Example 1. However, the toner composition is adjusted to include higher levels of fine particles (size <5 microns). Four different fine particles loading levels (40%, 50%, 60% and 70%) and three different production methods (described below) are used to prepare the toner compositions.

Toner grind method: During the toner grinding process, accomplished on a 200 AFG jet mill (Hosakawa), the target particle size is adjusted to match the volume median average after the nominal grinding and classification steps in Example 1. This adjustment is done by decreasing the grinder speed, increasing the feedrate, and decreasing the airflow, with the resulting fines content of the product of about 70%. The resulting product is routed directly to the additive blend step, bypassing the classification step of Example 1.

Toner class method: During the toner classification process, grind stock adjusted according to the previous paragraph is feed into a B 18 classifier (Hosakawa) with the classification the cutpoint adjusted by means of airflow and wheel speed to achieve a fines level of 40%, 50%, or 60%.

Additive blend method: in the blending step of blending the components together, additional fine particles (size <5 microns) are added to achieve the target fines content.

All of the thus produced toner compositions are measured to determine their actual average particle size and number percent content of fine particles. The results are provided in the-following Table. A nominal toner composition (without added fine particles) is presented for comparison.

| | | Particle Size Metrics after toner grind/class | | Particle Size Metrics after toner additive blend | | Particle Size Metrics after toner developer blend | |
|---|---|---|---|---|---|---|---|
| Processing Method | Target Fines level (number %) | Fine level (actual) (num %) | Vol. Medium size (μm) | Fine level (actual) (num %) | Vol. Medium size (μm) | Fine level (actual) (num %) | Vol. Medium size (μm) |
| Reference (Comparative Example 1) | 11–13 | 11–13 | 8.3 ± 1.4 | 11–13 | 8.3 ± 1.4 | 11–13 | 8.3 ± 1.4 |
| Toner grind method | 70 | 71.7 | 8.44 | 72.51 | 8.42 | 67.41 | 8.57 |
| Toner class method | 40 | 39.4 | 8.61 | 40.78 | 8.69 | 42.26 | 8.52 |
| Toner class method | 50 | 49.0 | 8.04 | 49.23 | 7.81 | 46.39 | 7.8 |
| Toner class method | 60 | 61.3 | 8.56 | 56.19 | 9.89 | 61.93 | 8.51 |
| Additive blend method | 50 | 11–13 | 8.3 ± 1.4 | 51.22 | 8.04 | Not measured | Not measured |

FIG. 5 provides a particle size distribution graph showing three of the toners of this Example. In particular, the graph provides the particle size distribution of the nominal (11–13 number % fines) toner, and the 50% fines toners prepared by the additive blend and toner class methods.

Example 3

A series of black toners are prepared generally according to the procedures of Comparative Example 1. The black toner is prepared by melt mixing together, 5% by weight carbon black in a propoxylated bisphenol A fumarate resin having a gel content of about 8% by weight. The toner also comprises as external surface additive package including 4.2% by weight HMDS treated silica with a 40 nanometer average particle diameter, 0.9% by weight decyltrimethoxysilane (DTMS) treated titania with a 40 nanometer average particle diameter (SMT-5103, available from Tayca Corporation), and 0.5% by weight Zinc Stearate L available from Ferro Corporation. However, the toner composition is adjusted to include higher levels of fine particles (size <5 microns). As in Example 2, four different fine particles loading levels (40%, 50%, 60% and 70%) and three different production methods (described in Example 2) are used to prepare the toner compositions.

All of the thus produced toner compositions are,measured to determine their actual average particle size and number percent content of fine particles. The results are provided in the following Table. A nominal toner composition (without added fine particles) is presented for comparison.

| | | Particle Size Metrics after toner grind/class | | Particle Size Metrics after toner additive blend | | Particle Size Metrics after toner developer blend | |
|---|---|---|---|---|---|---|---|
| Processing Method | Target Fines level (number %) | Fine level (actual) (num %) | Vol. Medium size (μm) | Fine level (actual) (num %) | Vol. Medium size (μm) | Fine level (actual) (num %) | Vol. Medium size (μm) |
| Reference | 11–13 | 11–13 | 8.3 ± 1.4 | 11–13 | 8.3 ± 1.4 | 11–13 | 8.3 ± 1.4 |
| Toner grind method | 70 | 70.1 | 7.71 | 72.14 | 7.42 | 65.46 | 7.54 |
| Toner class method | 40 | 39.4 | 8.00 | 43.69 | 7.98 | 40.73 | 7.91 |
| Toner class method | 50 | 48.2 | 7.84 | 49.7 | 7.88 | 49.05 | 7.73 |
| Toner class method | 60 | 58.5 | 8.22 | 60.94 | 9.07 | 57.27 | 8.95 |
| Additive blend method | 50 | 11–13 | 8.3 ± 1.4 | 54.27 | 8.07 | Not measured | Not measured |

FIG. 6 provides a particle size distribution graph showing three of the toners of this Example. In particular, the graph provides the particle size distribution of the nominal (11–13 number % fines) toner, and the 50% fines toners prepared by the additive blend and toner class methods.

What is claimed is:

1. A method for reducing super wire history image defects in an image development system comprising one or more electrode wires disposed in a gap between a toner donor roll and an imaging member, said method comprising:

providing an initial toner composition in said image development system, said initial toner composition containing at least 30 number % fine particles having a particle size no greater than 5 μm; and providing replenisher toner into the development system to replenish the toner used to produce images by the image development system; wherein said replenisher toner contains 20 number % or less fine particles having a particle size no greater than 5 μm.

2. The method according to claim 1, wherein said providing an initial toner composition comprises charging said initial toner composition into said image development system.

3. The method according to claim 1, further comprising operating said image development system to provide one or more printed images.

4. The method according to claim 3, wherein said super wire history image defect is overcome after less than about 5,000 printed images are made.

5. The method according to claim 3, wherein ΔE between a region that has the SWH defect and a background area where there is no image content change does not exceed about 6 during a useful life of said fresh toner composition.

6. The method according to claim 1, wherein said initial toner composition contains at least 40 number % fine particles having a particle size no greater than 5 μm.

7. The method according to claim 1, wherein said initial toner composition contains from about 40 to about 60 number % fine particles having a particle size no greater than 5 μm.

8. The method according to claim 1, wherein said initial toner composition contains at least 40 number % fine particles having a particle size no greater than 4 μm.

9. The method according to claim 1, wherein said initial toner composition contains substantially no ultra-fine particles having a particle size no greater than 2 μm.

10. The method according to claim 1, wherein said initial toner composition has a number average particle size of from about 6 to about 10 μm.

11. The method according to claim 1, wherein said replenisher toner contains 15 number % or less fine particles having a particle size no greater than 5 μm.

12. Apparatus for developing latent electrostatic images on a charge retentive surface with toner, said apparatus comprising:

a charge retentive surface;

a development unit comprising an initial supply of toner comprising at least 30 number % fine particles having a particle size no greater than 5 μm;

a replenisher toner supply unit for supplying replenisher toner to said development unit as toner in said development unit is used, wherein said replenisher toner comprises 20 number % or less fine particles having a particle size no greater than 5 μm;

a donor structure spaced from said charge retentive surface for conveying toner from said development unit to an area opposite said charge retentive surface; and one or more electrode wires positioned in a gap between said charge retentive surface and said donor structure and sufficiently close to said donor structure to permit detaching of toner from a surface of said donor structure by an electrostatic field to thereby produce-toner clouding about said one or more electrode wires.

13. The apparatus of claim 12, wherein said initial supply of toner has not been used to generate printed images.

14. The apparatus of claim 12, wherein said apparatus does not exhibit super wire history image defects after about 5,000 printed images are made.

15. The apparatus of claim 12, wherein when the apparatus is used to generate a printed image, ΔE between a region that has a super wire history image defect and a background area where there is no image content change does not exceed about 6 during a useful life of said toner composition.

16. The apparatus of claim 12, wherein said initial supply of toner contains at least 40 number % fine particles having a particle size no greater than 5 μm.

17. The apparatus of claim 12, wherein said initial supply of toner contains from about 40 to about 60 number % fine particles having a particle size no greater than 5 μm.

18. The apparatus of claim 12, wherein said initial supply of toner contains at least 40 number % fine particles having a particle size no greater than 4 μm.

19. The apparatus of claim 12, wherein said initial supply of toner contains substantially no ultra-fine particles having a particle size no greater than 2 μm.

20. The apparatus of claim 12, wherein an equilibrium content of toner fine particles having a particular size no greater than 5 μm in said apparatus is achieved within about a first 5,000 printed images generated by said apparatus.

21. The apparatus of claim 12, wherein said one or more electrode wires achieve an equilibrium amount of accumulated toner particles thereon within about a first 5,000 printed images generated by said apparatus.

* * * * *